US008651344B2

(12) United States Patent
Norman et al.

(10) Patent No.: US 8,651,344 B2
(45) Date of Patent: Feb. 18, 2014

(54) FLIP-FLOP HANGER

(75) Inventors: Michael Norman, East Brunswick, NJ (US); Keith Cedro, Clifton, NJ (US); Jake Strassburger, South Plainfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 301 days.

(21) Appl. No.: 13/224,956

(22) Filed: Sep. 2, 2011

(65) Prior Publication Data

US 2012/0061336 A1 Mar. 15, 2012

Related U.S. Application Data

(60) Provisional application No. 61/381,535, filed on Sep. 10, 2010.

(51) Int. Cl.
*A41D 27/22* (2006.01)

(52) U.S. Cl.
USPC ..... 223/87

(58) Field of Classification Search
USPC ..... 211/34, 85.3; 206/278, 292; 223/85, 87, 223/88, 89
See application file for complete search history.

(56) References Cited

U.S. PATENT DOCUMENTS

| | | | | | |
|---|---|---|---|---|---|
| 3,710,996 | A | * | 1/1973 | Smilow et al. | 223/87 |
| 4,023,762 | A | * | 5/1977 | Batts et al. | 248/340 |
| 4,063,669 | A | | 12/1977 | Smilow et al. | |
| 4,714,156 | A | * | 12/1987 | Kolton et al. | 206/296 |
| 5,005,741 | A | | 4/1991 | Kolton et al. | |
| 5,222,638 | A | | 6/1993 | Kolton et al. | |
| 5,240,123 | A | * | 8/1993 | Hawk | 211/32 |
| 5,282,553 | A | * | 2/1994 | Ibled | 223/85 |
| 5,421,494 | A | * | 6/1995 | Kolton et al. | 223/85 |
| 5,626,268 | A | | 5/1997 | Kolton et al. | |
| 5,911,347 | A | * | 6/1999 | Jackstat et al. | 223/85 |
| D412,111 | S | * | 7/1999 | Josephs | D9/722 |
| 5,931,314 | A | * | 8/1999 | Jackstat et al. | 211/34 |
| 6,299,039 | B1 | | 10/2001 | Hsu | |
| 6,497,347 | B1 | | 12/2002 | Feibelman et al. | |
| 6,595,355 | B1 | * | 7/2003 | Hooper | 206/292 |
| 6,612,430 | B1 | * | 9/2003 | Silvera | 206/294 |
| 7,448,520 | B2 | | 11/2008 | Kolton et al. | |
| 2005/0035004 | A1 | * | 2/2005 | Kolton et al. | 206/6.1 |
| 2007/0251894 | A1 | * | 11/2007 | Kelley | 211/34 |
| 2008/0110943 | A1 | * | 5/2008 | Kolton et al. | 223/85 |
| 2009/0071917 | A1 | * | 3/2009 | Hathorn | 211/34 |
| 2010/0084353 | A1 | * | 4/2010 | Barker et al. | 211/34 |
| 2013/0200015 | A1 | * | 8/2013 | Kalinsky | 211/34 |

* cited by examiner

*Primary Examiner* — Jonathan Liu
*Assistant Examiner* — Patrick Hawn
(74) *Attorney, Agent, or Firm* — Hoffmann & Baron, LLP

(57) ABSTRACT

A flip-flop hanger having an elongated body, a hook, an attachment device, an attachment aperture and two disc-shaped sections. The attachment device is disposed near the second end of the elongated body and the attachment aperture is located in the mid-section of the elongated body. The disc-shaped sections are disposed between the attachment device and the attachment aperture. Each disc-shaped section has an outer perimetrical edge, a central opening and a slot that extends between the central opening and the outer perimetrical edge. The central openings in the disc-shaped sections attach to the flip-flop straps between the bottom of the soles and the retaining devices. After the flip-flops are attached, the body is folded and the attachment device engages the attachment aperture. The flip-flop hanger can then be affixed to a rack or merchandise display.

20 Claims, 4 Drawing Sheets

FLIP-FLOP HANGER

This application claims priority from provisional application Ser. No. 61/381,535, filed on Sep. 10, 2010, which is incorporated herein in its entirety.

FIELD OF THE INVENTION

The present invention relates to hangers that are used in the packaging and display of footwear. In particular, the present invention relates to hangers that are secured to flip-flops and hung from merchandise displays.

BACKGROUND OF INVENTION

Small articles are commonly displayed for sale in retail stores on racks or in display cases where the articles are hung. A variety of different hangers and tags have been used that are secured to the article and have a means for attaching the article to the rack for display. Several of the criteria for designing these hangers relate to the cost of manufacturing the hangers and the cost of attaching them to the articles. Another important design consideration is that the hangers must be convenient for the merchant to display and they must be convenient for the customer to remove after purchase.

Hangers used for displaying footwear, such as flip-flops, must be designed so that the customer can easily view the flip-flops and remove them from the display rack. The hangers must also be designed so that the customer can easily try on at least one of the flip-flops without having to remove the hanger. Because a customer may try on several pairs of flip-flops before making a selection, the hangers must be designed so that they can be removed and then reinstalled on the rack by the customer numerous times without damaging either the flip-flops or the hangers.

Accordingly, there is a need for a hanger for displaying flip-flops that can be easily removed and reinstalled in the display and that does not prevent the flip-flops from being worn by a customer. There is also a need for a hanger for displaying flip-flops that can be economically manufactured and easily and firmly secured to the flip-flops.

SUMMARY OF THE INVENTION

In accordance with the present invention, a hanger with a hook for securing together and displaying a pair of flip-flops is provided. The term flip-flops, as it is used herein, refers to a form of footwear that has a substantially flat sole and a Y-shaped strap on the top of the sole that is secured to the sole at each of the three ends. The one end at the base of the Y fits between the big toe and second toe of the foot and passes through the sole and is secured to the bottom of the sole by a retaining device. The two other ends of the strap are secured to the sole on either side of the foot of the person wearing the flip-fop near the middle portion of the sole.

The flip-flop hanger includes an elongated body, a hook, an attachment device, an attachment aperture a first disc-shaped section and a second disc-shaped section therebetween. The elongated body has a longitudinal axis defined by a first end and a second end and a mid-section. The body is substantially flat and can include one or more fold lines between the first disc-shaped section and the second disc-shaped section. The fold lines facilitate folding the elongated body at desired locations. The body can be constructed of nylon, polypropylene, polyethylene or polyvinyl chloride. The hanger can also include one or more panels located between the first end and the mid-section of the body. The hook extends from the first end of the elongated body and is used to hang the hanger from a display after the flip-flops are attached.

The attachment device is disposed near the second end of the elongated body and the attachment aperture is located in the mid-section of the elongated body. The attachment device extends from a base affixed to the body to a distal end. The base has a diameter and the distal end has a diameter greater than the diameter of the base. The aperture has a diameter that is less than the diameter of the distal end but greater than the diameter of the base. The distal end of the attachment device is inserted into and through the attachment aperture to secure the second end of the body to the mid-section.

The first disc-shaped section and the second disc-shaped section are disposed between the attachment device and the attachment aperture, with the first disc-shaped section located between the first end of the body and the second disc-shaped section. Each disc-shaped section has an outer perimetrical edge, a central opening and a slot that extends between the central opening and the outer perimetrical edge. The central openings in the first and second disc-shaped sections have a diameter of between ¼-inch and ¾-inch, preferably about ½-inch. Preferably, the diameter of the central openings in the disc-shaped sections is greater than the width of the slots and less than the diameter of the flip-flop retaining device. The slot in the first disc-shaped section extends towards the first end of the body at an angle of between 15 and 75 degrees, preferably between 30 and 60 degrees and most preferably about 45 degrees with respect to the longitudinal axis. The slot in the second disc-shaped section extends towards the second end of the body at an angle of between 15 and 75 degrees, preferably between 30 and 60 degrees and most preferably about 45 degrees with respect to the longitudinal axis. When the flip-flops are attached to the hanger and the attachment device is secured to the attachment aperture, the slots in the two disc-shaped sections extend towards the hook. This prevents the flip-flops from falling out of the hanger when the hanger is attached to a display rack by the hook.

Each of the central openings in the first and second disc-shaped sections attaches to a flip-flop strap between the bottom of the sole and the retaining device. The straps on the flip-flops slide through the slots in the disc-shaped sections to the central openings. The flip-flop retaining devices, which have diameters greater than the diameters of the central openings, secure the flip-flops in the central openings. The elongated body is folded and the attachment device engages the attachment aperture. When the attachment device engages the attachment aperture, the central openings in the first and second disc-shaped sections are substantially aligned. The flip-flop hanger can then be affixed to a rack or merchandise display.

BRIEF DESCRIPTION OF THE FIGURES

The preferred embodiments of the flip-flop hanger of the present invention, as well as other objects, features and advantages of this invention, will be apparent from the accompanying drawings wherein.

DETAILED DESCRIPTION OF THE INVENTION

Figure 3:
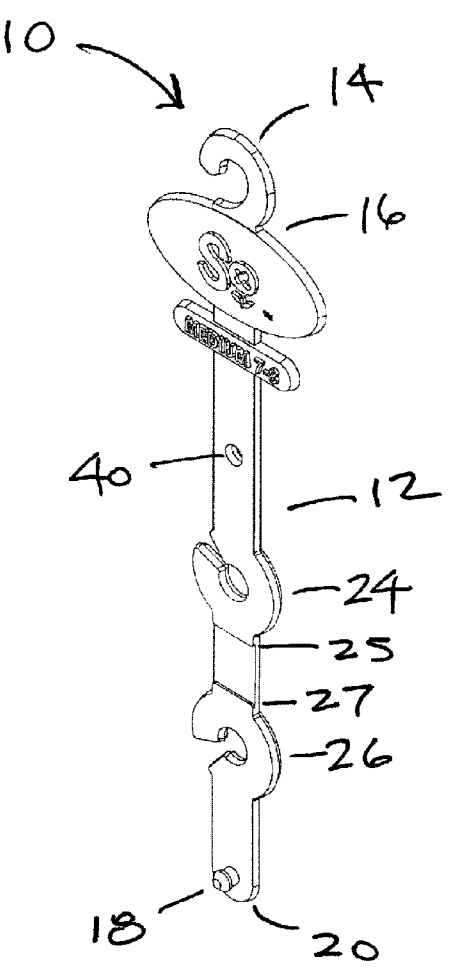
FIG. 3 is a front perspective of the flip-flop hanger shown in FIG. 1.

The present invention is a flip-flop hanger with a hook that is attached to a pair of flip-flops and then hung from a display. Typically, each flip-flop has a substantially flat sole and a Y-shaped strap on the top of the sole that includes a base and two legs. (See FIGS. 7-9.) The base portion of the strap passes through a hole in the sole and is secured to the bottom of the sole by a retaining device. The two legs extend from the base portion and pass around the user's foot before being secured to the sole. The flip-flop hanger has an elongated body, a hook, an attachment device, an attachment aperture, a first disc-shaped section and a second disc-shaped section. The flip-flop hanger is made from nylon or a flexible plastic material, preferably polypropylene, polyethylene, polyvinyl chloride. However, the material used to make the flip-flop hanger does not limit the scope of the invention in any way and one skilled in the art would appreciate that a variety of different materials can be used.

The elongated body has a first end, a second end and a mid-section. The hook extends from the first end of the elongated body and is used for hanging the flip-flop hanger from a display after the flip-flops are secured to the hanger. The attachment device can be disposed near the second end (also referred to herein as the connecting end) of the elongated body and the attachment aperture can be located in the mid-section of the elongated body. However, in other embodiments of the hanger, the locations can be reversed and the attachment device can be located in the mid-section of the elongated body and the attachment aperture can be disposed near the second end of the elongated body. It is also contemplated that in place of the attachment device and the attachment aperture a fastener or snap can be substituted. One skilled in the art would understand that any device that secured the connecting end of the hanger to the mid-section would be suitable.

The first disc-shaped section and the second disc-shaped section are disposed between the attachment device and the attachment aperture. Each disc-shaped section has an outer perimetrical edge, a central opening and a slot that extends between the central opening and the outer perimetrical edge. Each of the central openings in the first and second disc-shaped sections is adapted for attachment of a flip-flop strap between the bottom of the sole and the retaining device. The central openings in the first disc-shaped section and the second disc-shaped section have a diameter of at least ¼-inch and the slots have a width of at least ⅛-inch. Preferably, the central openings in the first and second disc-shaped sections have a diameter of between ¼-inch and ¾-inch and the diameter is greater than the width of the slot. The strap slides through the slot and is secured in the central opening by the retaining device on the flip-flop strap. After the two flip-flops are secured in the central openings of the disc-shaped sections, the elongated body is folded and the attachment device engages the attachment aperture with the soles of the flip-flops opposing each other.

The hanger can have one or more panels located between the attachment aperture/attachment device and the hook that can be used for displaying information about the flip-flops, such as a logo, price, bar code and/or size. Preferably, the panels are transversely oriented with respect to the elongated body of the hanger, i.e., the length of the hanger body is at a right angle to the panels. The hanger is preferably made form a plastic material using a variety of well known casting or molding methods. However, materials other than plastics can be used, such as paper, cardboard and/or laminates, without limiting the scope of the invention in any way.

Figure 2:
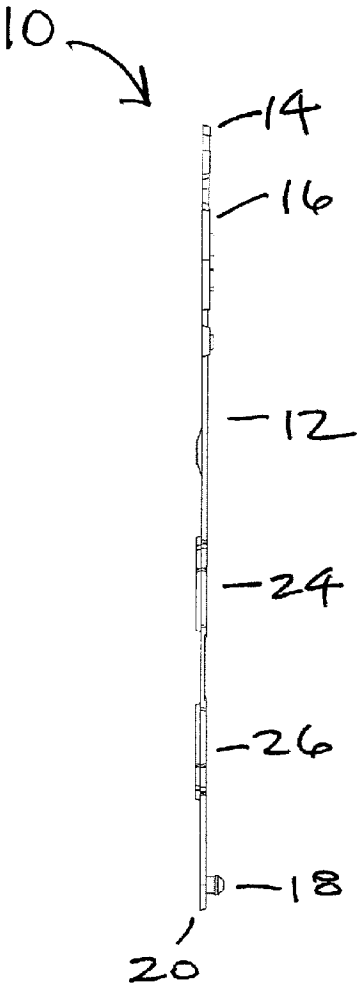
FIG. 2 is a side view of the flip-flop hanger shown in FIG. 1.
Figure 1:
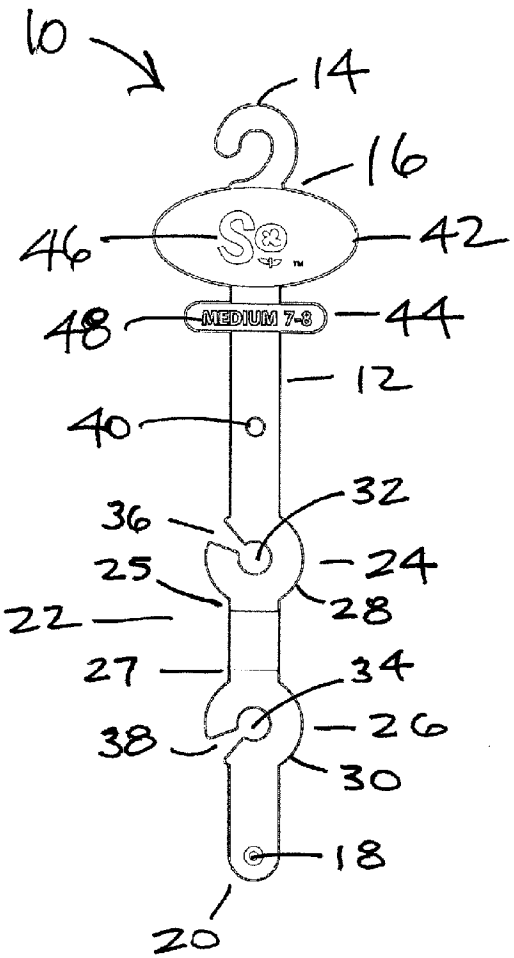
FIG. 1 is a front view of a preferred embodiment of the flip-flop hanger of the present invention.

Turning now to the figures, FIGS. 1-3 show the flip-flop hanger 10 of the present invention, which has a body 12 with a hook 14 at the first end 16 and an attachment device 18 at the second end 20. The body 12 has a mid-section 22 that includes two disc-shaped sections 24, 26. Each disc-shaped section 24, 26 has an outer perimetrical edge 28, 30, a central opening 32, 34 and a slot 36, 38 that extends between the central opening 32, 34 and the outer perimetrical edge 28, 30. Each of the central openings 32, 34 is adapted for attachment of the base 918 of the flip-flop strap 916 between the bottom surface 916 of the sole 912 and the retaining device 922 (FIG. 9) as described in more detail below with respect to FIG. 11. An attachment aperture 40 is located between the two disc-shaped sections 24, 26 and the first end 16. After the elongated body 12 is folded along the fold lines 25, 27 at a point between the two disc-shaped sections 24, 26, the attachment aperture 40 attachably receives the attachment device 18.

The hanger 10 has two panels 42, 44 located between the attachment aperture 40 and the hook 14 on the first end 16. The first panel 42 displays a logo 46 and the second panel 44 displays a size 48. The panels 42, 44 are transversely oriented with respect to the body 12 so that when the hanger 10 is attached to a display using the hook 14, the information on the panels 42, 44 can be easily read by customers.

Figure 6:
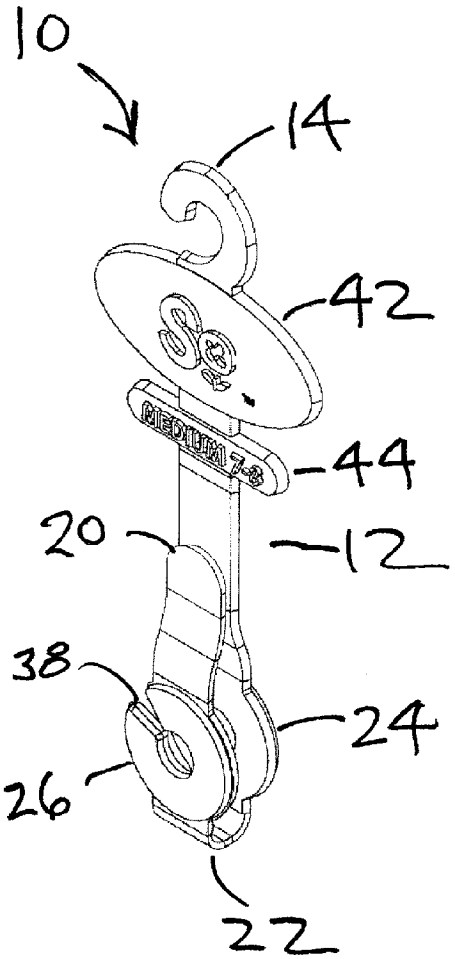
FIG. 6 is a front perspective view of the flip-flop hanger shown in FIG. 1 with the second end folded over and attached to the mid-section of the hanger.
Figure 5:
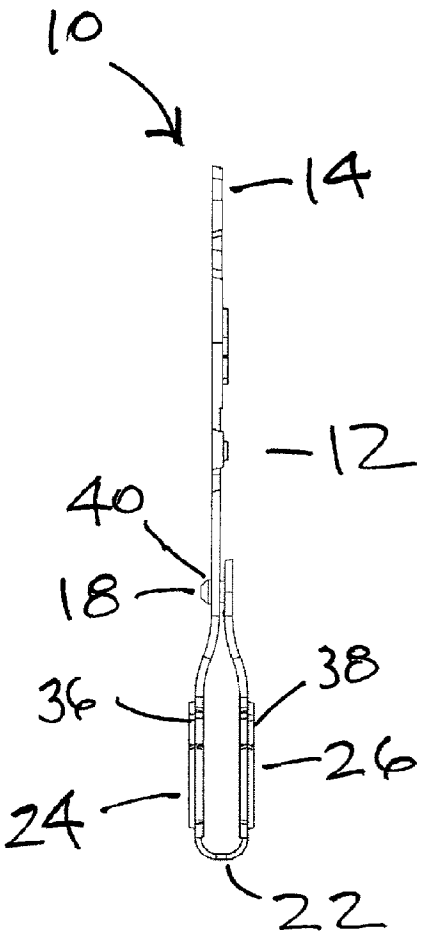
FIG. 5 is a side view of the flip-flop hanger shown in FIG. 1 with the second end folded over and attached to the mid-section of the hanger.
Figure 4:
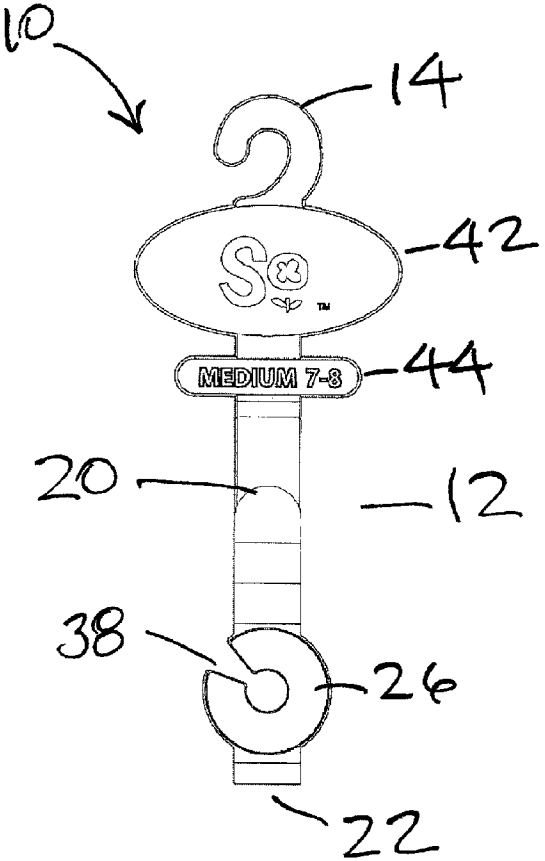
FIG. 4 is a front view of the flip-flop hanger shown in FIG. 1 with the second end folded over and attached to the mid-section of the hanger.

FIGS. 4-6 show the hanger 10 after it has been folded at a point between the two disc-shaped sections 24, 26 and the attachment device 18 has been secured in the attachment aperture 40. FIGS. 4-6 show the configuration of the hanger 10 when the hanger 10 is ready to be displayed. The flip-flops are not shown in FIGS. 4-6 so that the features of the hanger 10 can be more clearly illustrated. The figures illustrate how the slots 36, 38 are configured so that they are disposed at an upward angle when the hanger 10 is attached by the hook 14. This prevents the flip-flops from becoming detached from the hanger 10.

Figure 7:
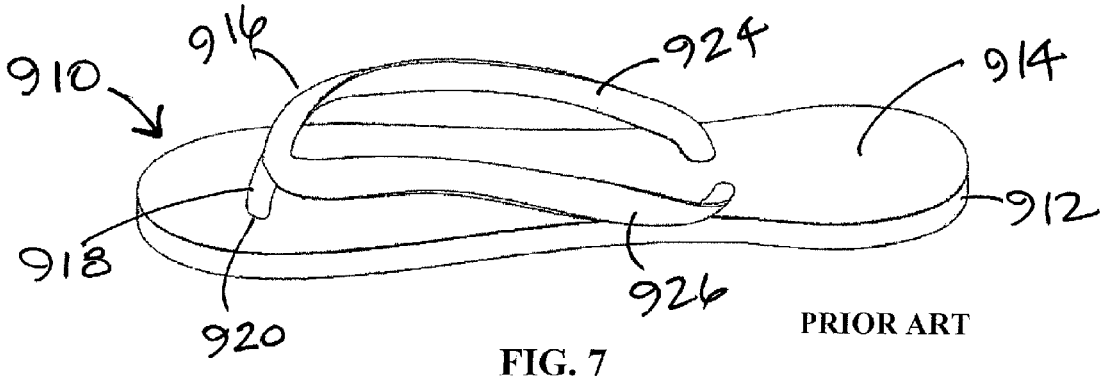
PRIOR ART FIG. 7
FIG. 7 is a perspective view of a prior art flip-flop.
Figure 8:
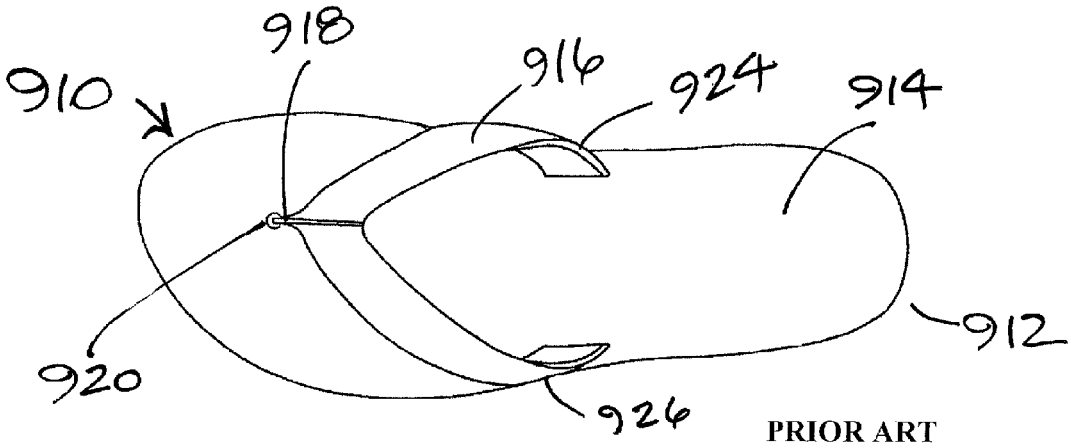
PRIOR ART FIG. 8
FIG. 8 is a top view of a prior art flip-flop.
Figure 9:
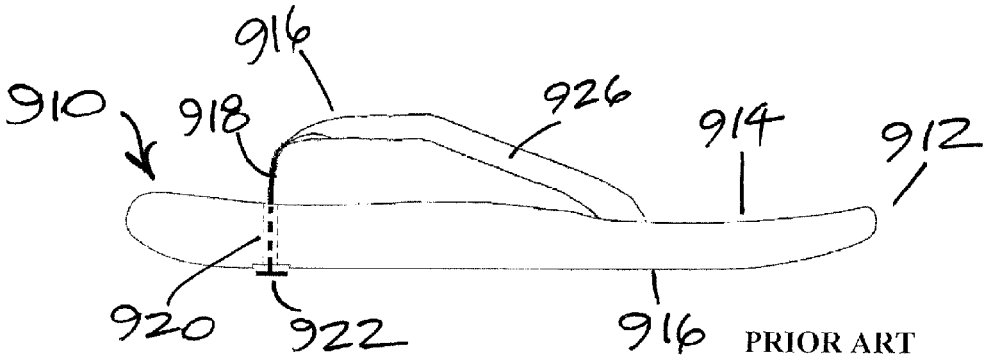
PRIOR ART FIG. 9
FIG. 9 is a side view of a prior art flip-flop.

FIGS. 7-9 show prior art flip-flops 910. The term "flip-flops" as used herein refers to an open type of outdoor footwear, consisting of a flat sole 912 having a top surface 914 and a bottom surface 916 and held loosely on the foot by a Y-shaped strap 916 that operates like a thin thong. The base 918 of the Y-shaped strap 916 passes between the first (big toe) and second toes (not shown), through a hole 920 in the sole 912 and is secured on the bottom side 916 of the sole 912 by a retaining device 922 that is too large to pass through the hole 920. The two legs 924, 926 of the Y-shaped strap 916 pass around either side of the foot (not shown) and are secured to the sole 912. Unlike sandals, flip-flops 912 do not secure the ankle.

Figure 10:
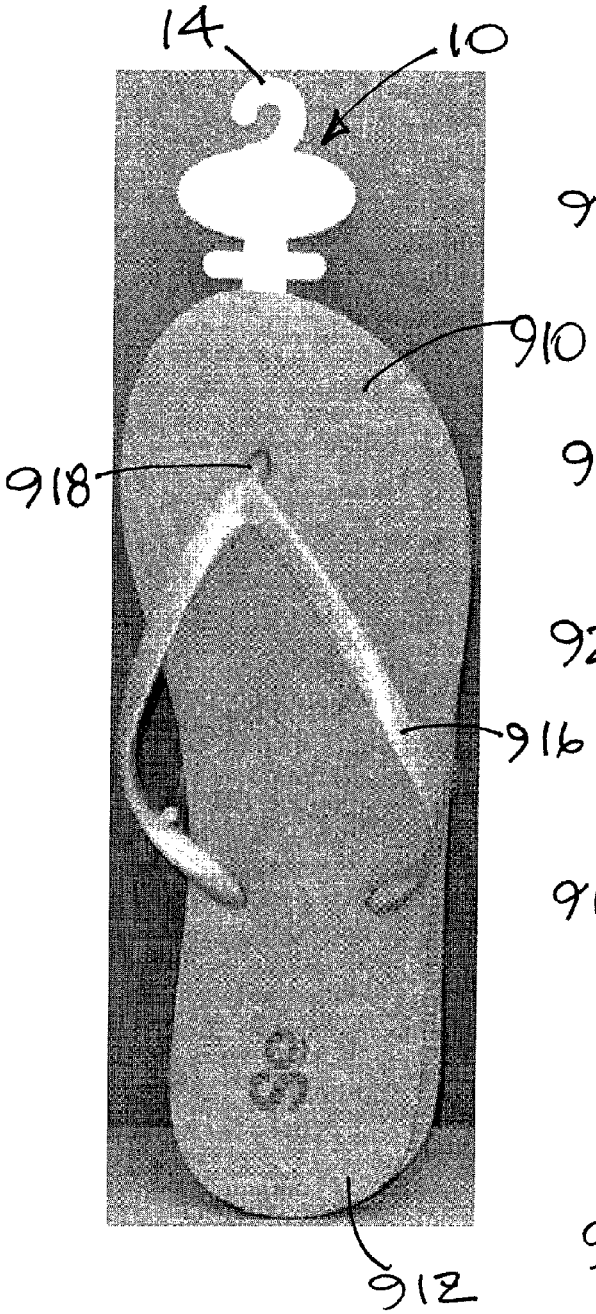
FIG. 10 is a front view of the flip-flop hanger shown in FIG. 1 attached to a flip-flop.
Figure 11:
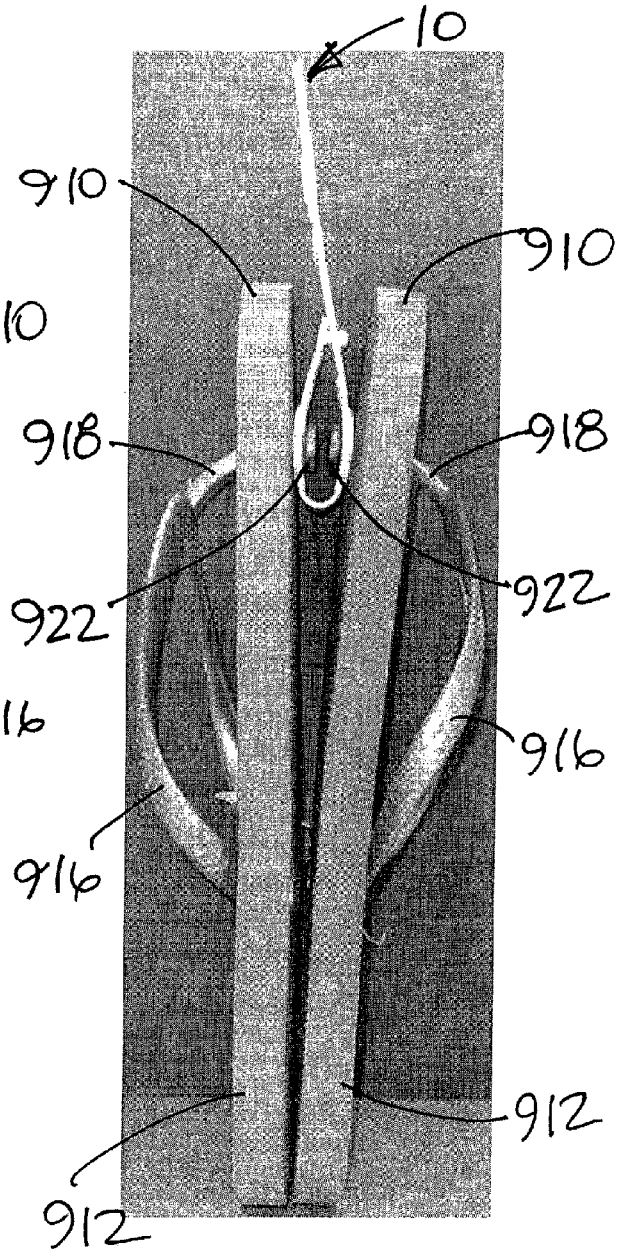
FIG. 11 is a side view of the flip-flop hanger shown in FIG. 1 attached to a pair of flip-flops.

FIGS. 10 and 11 show the hanger 10 attached to flip-flops 910. As FIG. 10 shows, the hanger 10 is attached to the retaining device 922 on the bottom side of the flip-flop 910. The retaining device 922 on the end of the base portion 918 of the strap 916 is larger than the central openings 32, 34 in the disc-shaped sections 24, 26 so that, after the base portion 918 is inserted in one of the slots 36, 38, the retaining device 922 secures the flip-flop 910 in the hanger 10. After the two flip-flops 910 are secured in the central openings 32, 34, the elongated body 12 is folded and the attachment device 18 engages the attachment aperture 40 as shown in FIG. 5.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A flip-flop hanger for attachment to a pair of flip-flops having a substantially flat sole and a Y-shaped strap on the top of the sole that passes through the sole and is secured to the bottom of the sole by a retaining device, the flip-flop hanger comprising:

an elongated body having a longitudinal axis defined by a first end and a second end and a mid-section;

a hook extending from the first end of the elongated body;

an attachment device disposed between the mid-section and the second end of the elongated body;

an attachment aperture located in the mid-section of the elongated body; and a first disc-shaped section and a second disc-shaped section disposed between the attachment device and the attachment aperture, wherein each disc-shaped section has an outer perimetrical edge, a central opening and a slot that extends between the central opening and the outer perimetrical edge;

wherein each of the central openings in the first and second disc-shaped sections is attached to the flip-flop strap of one of the pair of flip-flops flip-flop strap between the bottom of the sole and the retaining device, and wherein the elongated body is folded and the attachment device engages the attachment aperture.

2. The flip-flop hanger according to claim 1, wherein the slot in the first disc-shaped section extends towards the first end of the body at an angle of between 30 and 60 degrees with respect to the longitudinal axis.

3. The flip-flop hanger according to claim 1, wherein the slot in the second disc-shaped section extends towards the second end of the body at an angle of between 30 and 60 degrees with respect to the longitudinal axis.

4. The flip-flop hanger according to claim 1, wherein the attachment device extends from a base affixed to the body to a distal end, and wherein the base has a diameter and the distal end has a diameter greater than the diameter of the base.

5. The flip-flop hanger according to claim 1, further comprising one or more panels located between the first end and the mid-section of the body.

6. The flip-flop hanger according to claim 1, further comprising one or more fold lines between the first disc-shaped section and the second disc-shaped section.

7. The flip-flop hanger according to claim 1, wherein the body is substantially flat.

8. The flip-flop hanger according to claim 1, wherein, when the attachment device engages the attachment aperture, the central openings in the first disc-shaped section and the second disc-shaped section are substantially aligned.

9. The flip-flop hanger according to claim 1, wherein the body is constructed of nylon, polypropylene, polyethylene or polyvinyl chloride.

10. The flip-flop hanger according to claim 1, wherein the central openings in the first disc-shaped section and the second disc-shaped section have a diameter of between ¼-inch and ¾-inch.

11. The flip-flop hanger according to claim 1, wherein the central openings in the first disc-shaped section and the second disc-shaped section have a diameter and the slots have a width, and wherein the diameter is greater than the width.

12. A flip-flop hanger for attachment to a pair of flip-flops having a substantially flat sole and a Y-shaped strap on the top of the sole that passes through the sole and is secured to the bottom of the sole by a retaining device, the flip-flop hanger comprising:

a substantially flat, elongated body having a longitudinal axis extending between a first end and a second end and having a mid-section therebetween;

a hook extending from the first end of the elongated body;

an attachment device disposed between the mid-section and the second end of the elongated body;

an attachment aperture located in the mid-section of the elongated body; and a first disc-shaped section and a second disc-shaped section disposed between the attachment device and the attachment aperture, wherein each disc-shaped section has an outer perimetrical edge, a central opening and a slot that extends between the central opening and the outer perimetrical edge, wherein the central openings in the first disc-shaped section and the second disc-shaped section have a diameter of between ¼-inch and ¾-inch;

wherein each of the central openings in the first and second disc-shaped sections is attached to the flip-flop strap of one of the pair of flip-flops flip-flop strap between the bottom of the sole and the retaining device, and wherein the elongated body is folded and the attachment device engages the attachment aperture.

13. The flip-flop hanger according to claim 12, wherein the slot in the first disc-shaped section extends towards the first end of the body at an angle of between 30 and 60 degrees with respect to the longitudinal axis.

14. The flip-flop hanger according to claim 12, wherein the slot in the second disc-shaped section extends towards the second end of the body at an angle of between 30 and 60 degrees with respect to the longitudinal axis.

15. The flip-flop hanger according to claim 12, wherein the attachment device extends from a base affixed to the body to a distal end, and wherein the base has a diameter and the distal end has a diameter greater than the diameter of the base.

16. The flip-flop hanger according to claim 12, further comprising one or more panels located between the first end and the mid-section of the body.

17. The flip-flop hanger according to claim 12, further comprising one or more fold lines between the first disc-shaped section and the second disc-shaped section.

18. The flip-flop hanger according to claim 12, wherein, when the attachment device engages the attachment aperture, the central openings in the first disc-shaped section and the second disc-shaped section are substantially aligned.

19. A flip-flop hanger for attachment to a pair of flip-flops having a substantially flat sole and a Y-shaped strap on the top of the sole that passes through the sole and is secured to the bottom of the sole by a retaining device, the flip-flop hanger comprising:

a substantially flat, elongated body having a longitudinal axis extending between a first end and a second end and having a mid-section therebetween;

a hook extending from the first end of the elongated body;

an attachment device disposed between the mid-section and the second end of the elongated body, wherein the attachment device extends from a base affixed to the body to a distal end, and wherein the base has a diameter and the distal end has a diameter greater than the diameter of the base;

an attachment aperture located in the mid-section of the elongated body; and a first disc-shaped section and a second disc-shaped section disposed between the attachment device and the attachment aperture, wherein each disc-shaped section has an outer perimetrical edge, a central opening and a slot that extends between the central opening and the outer perimetrical edge, wherein the slot in the first disc-shaped section extends towards the first end of the body at an angle of between 15 and 75 degrees with respect to the longitudinal axis, wherein the slot in the second disc-shaped section extends towards the second end of the body at an angle of between 15 and 75 degrees with respect to the longitudinal axis;

wherein each of the central openings in the first and second disc-shaped sections is attached to the flip-flop strap of one of the pair of flip-flops flip-flop strap between the bottom of the sole and the retaining device, and wherein the elongated body is folded and the attachment device engages the attachment aperture.

20. The flip-flop hanger according to claim 12, further comprising one or more panels located between the first end and the mid-section of the body and one or more fold lines between the first disc-shaped section and the second disc-shaped section.

* * * * *